US006000111A

United States Patent [19]

Deskins et al.

[11] Patent Number: 6,000,111

[45] Date of Patent: Dec. 14, 1999

[54] DEVICE FOR CONTAINING, CONCEALING, AND PROTECTING FOOTWEAR FASTENERS

[76] Inventors: R. Timothy Deskins, 200 Norman Ave.; Arthur DeMarco, 2168 Rebecca Dr., both of Hatfield, Pa. 19440

[21] Appl. No.: 09/169,931

[22] Filed: Oct. 13, 1998

[51] Int. Cl.[6] ..... A43B 11/00

[52] U.S. Cl. ..... 24/712.3; 24/442; 24/712.1; 24/712.6

[58] Field of Search ..... 24/712.3, 712.1, 24/712.6, 713.6, 442

[56] References Cited

U.S. PATENT DOCUMENTS

| | | | |
|---|---|---|---|
| D. 356,675 | 3/1995 | Gamm | D2/975 |
| D. 369,237 | 4/1996 | Gamm | D2/975 |
| 1,371,637 | 3/1921 | Meredith | 24/712.3 |
| 3,473,198 | 10/1969 | Meier | 24/712.3 |
| 3,940,873 | 3/1976 | Lawless | 24/442 |
| 4,414,761 | 11/1983 | Mahood | 36/50.1 |
| 4,969,242 | 11/1990 | Carlton, Sr. | 24/712 |
| 5,022,127 | 6/1991 | Ang | 24/712.2 |
| 5,027,482 | 7/1991 | Torppey | 24/712.1 |
| 5,042,119 | 8/1991 | Williams | 24/442 |
| 5,165,190 | 11/1992 | Smyth | 24/712.3 |
| 5,170,573 | 12/1992 | Clinch | 36/50.1 |
| 5,353,483 | 10/1994 | Louviere | 24/712.1 |
| 5,566,477 | 10/1996 | Mathis et al. | 36/100 |
| 5,649,342 | 7/1997 | D'Andrade et al. | 24/712.2 |
| 5,778,500 | 7/1998 | Illingworth | 24/712.3 |

FOREIGN PATENT DOCUMENTS

| | | | |
|---|---|---|---|
| 0271364 | 1/1951 | Switzerland | 24/712.6 |

*Primary Examiner*—Victor N. Sakran
*Attorney, Agent, or Firm*—Joseph W. Molasky & Associates

[57] ABSTRACT

A device for containing, concealing and protecting footwear fasteners to keep the fasteners secure, clean, concealed and protected from snagging on foreign objects. The device is made of a pliable material so as to prevent injury in the event that the wearer or some other person comes into contact with the device. The device has a cover that may display fashionable designs and emblems, or reflective material for use in the dark.

22 Claims, 4 Drawing Sheets

DEVICE FOR CONTAINING, CONCEALING, AND PROTECTING FOOTWEAR FASTENERS

FIELD OF THE INVENTION

This invention relates to a device for covering, concealing, and protecting footwear fasteners so that the fasteners remain secure, clean, concealed, and protected from snagging on foreign objects.

This device is made of a pliable material so as to prevent injury in the event that the wearer or some other person comes into contact with the device. It also has a fashion purpose because designs and emblems can be added to the cover. It also contributes to wearer safety because the cover can be made of a reflective material for nighttime use.

BACKGROUND OF THE INVENTION

Shoelace covers are known in the art, and their decorative and function value is well recognized. Typical of such shoelace covers include, for example, U.S. Pat. Nos. 4,969,242 to Carlton, Sr., 5,022,127 to Ang, and 5,649,342 to D'Andrade et al., all of which teach a rigid, non-yielding shoelace cover.

Unfortunately, none of these prior art patents relate to a shoelace cover which is sufficiently pliable as to be safely useable during sporting activities or by young children at play. Moreover, none of these covers can be used with all styles and sizes of footwear, including those fastened with Velcro and speed laces. While all of the above-listed shoelace covers keep shoelaces from becoming untied, none provide the versatility, convenience, and safety which are characteristic of the shoelace covers of the present invention.

SUMMARY OF THE INVENTION

The present invention relates to a device for containing, concealing, and protecting footwear fasteners. This device can be used with footwear that is fastened by shoelaces, Velcro, or a combination of laces and Velcro, and it can be worn or taken off and interchanged with any other such device or other footwear.

The device prevents shoelace fasteners from becoming undone, and it conceals the fasteners, keeps them clean, and prevents them from snagging on foreign objects. Accordingly, this device serves many purposes, and it is beneficial to both children and adults since it may prevent injuries caused by tripping on untied shoelaces.

This device also has utility in the work place and the military because it prevents shoelaces from becoming untied and creating a safety hazard. Moreover, it also provides a convenient means for keeping shoelace fasteners clean.

This device is constructed from a flexible and supple material so as to prevent injury to the user or other as, for example, athletes in sporting events, workers in the workplace, and children engaged in play.

This device also has cosmetic value and versatility because an emblem, design, or advertising can be displayed on its cover, and it can be interchanged with other devices or other footwear to make a fashion statement. A protective purpose is also achieved by adding reflective material to the cover for nighttime use.

In one embodiment of this invention, the present device is a discrete appliance which is joined to the footwear to cover all of the laces whether they be conventional laces or speed laces or some combination of both.

The device also may be made a part of the footwear during manufacture as, for example, by being made an integral part of the tongue. Alternatively, it may be constructed as an accessory to be added to already manufactured footwear.

According to another embodiment, the device of this invention contains an inner pocket for carrying items such as money, keys, and the like.

The object of this invention is to provide a footwear fastener cover that will keep the fasteners fastened and clean and that is pliable enough to prevent injury to the user and to others.

Another object is to provide a footwear fastener cover which is ornamental and fashionable.

Still another object is to provide a footwear fastener cover which enhances user safety by adding a reflective member for nighttime use.

A further object is to provide a footwear fastener cover that covers all of the laces to protect against foreign objects and dirt.

A still further object is to provide a footwear fastener cover that can be adapted to fit all styles and sizes of footwear and which can be made a part of the footwear during manufacture or can be made as an accessory to be joined to the footwear after manufacture.

Still another object is to provide a footwear fastener cover that includes an inner pocket for carrying small items.

Other objects and advantages of this invention will become apparent from the following description taken in connection with the accompanying drawings which are presented by way of illustration and example.

DESCRIPTION OF THE PREFERRED EMBODIMENTS

Figure 1:
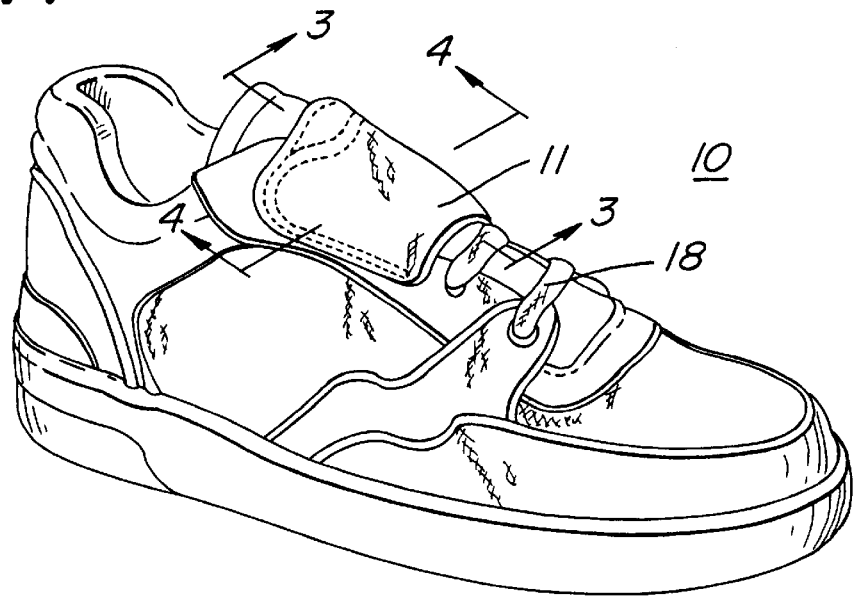
FIG. 1 is a perspective view showing the fastener cover of this invention in a closed mode in use condition.

Although specific terms are used in the following description for the sake of clarity, these terms are intended to refer only to the particular structure of the invention selected for illustration in the drawings, and are not intended to limit the scope of the invention.

Figure 2:
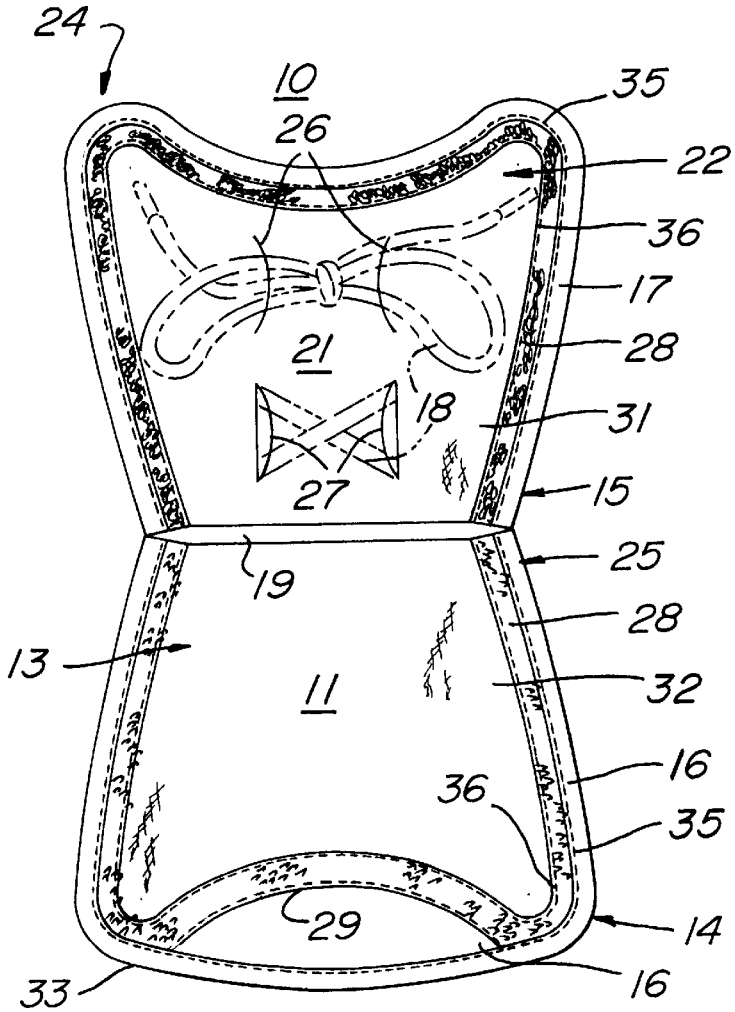
FIG. 2 is a plan view of the fastener cover of FIG. 1 in an open mode.

Reference is made to FIG. 1 and FIG. 2 which illustrate a device 10 for containing, concealing and protecting footwear fasteners which, in this instance, is a shoe lace 18. FIG. 1 shows the device 10 in a closed mode in use condition and FIG. 2 shows the device 10 in an open mode. The device 10 contains a top portion 11 and a bottom portion 21. The bottom portion 21 attaches to the footwear by the insertion of the footwear fasteners from the under side 23 (see FIG. 3) of the bottom portion 21 through the first pair of openings 26. Upon passing through the first pair of openings 26, the fasteners 18 are fastened on the upper side 22 of the bottom portion 21.

The fasteners can be any means of fastening footwear, including laces, VELCRO®, or a combination of laces and VELCRO®. If the footwear fasteners include laces, they may further attach the device 10 to the footwear by inserting the laces from the under side 23 of the bottom portion 21 through the second pair of openings 27, whereupon the laces are crossed over each other on the upper side 22 of the bottom portion 21, and passed back through the second pair of openings 27 to the under side 23 of the bottom portion 21.

Figure 3:
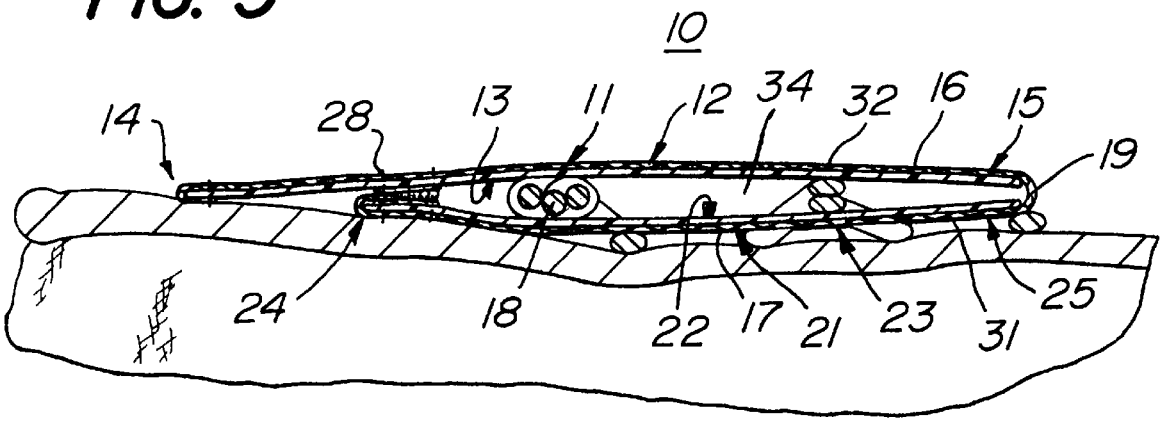
FIG. 3 is a cross-sectional view taken along section 3—3 of FIG. 1.

Reference is now made to FIG. 2 and FIG. 3. FIG. 3 is a cross-sectional view taken along section 3—3 of FIG. 1. The exterior side 12 of the top portion 11 is overlaid with a cover 16 and the under side 23 of the bottom portion 21 is overlaid with a with an outer layer 17. The cover 16 and outer layer 17 may be made of any sufficiently pliable material, however, the preferred materials are cloth, leather, vinyl, and plastic. The cover 16 is integrally connected to the outer layer 17 thereby connecting the top portion toe end 15 to the bottom portion toe end 25. When the device 10 is in the closed mode, a pocketed space 34 is defined between the interior side 13 of the top portion 11 and the upper side 22 of the bottom portion 21.

A bottom portion stiffening means 31 and a top portion stiffening means 32 are provided. However, in practice, the bottom portion stiffening means 31 is considered optional. The stiffening means may be made of any suitably firm material although plastic is preferred. The thickness of this stiffening means may vary from device to device.

The bottom portion ankle end 24 includes a curved indentation 29. In addition, the top portion stiffening means 32 has a curved indentation 29 at the top portion ankle end 14. The curved indentation 29 prevents the device from cutting into the wearer's ankle.

The cover 16 does not have a curved indentation, but rather extends across the curved indentation 29 of the top portion stiffening means 32. The portion of the cover that extends over the curved indentation 29 of the top portion stiffening means creates a grip 33 that may be used to open the device 10 when it is in the closed mode.

The periphery of the upper side 22 of the bottom portion 21, excluding the periphery of the bottom portion toe end 25, and the periphery of the interior side 13 of the top portion 11, excluding the periphery of the top portion toe end 15, have an attachment means 28. While any attachment means may be used, the preferred attachment means is by loop and hook material sold under the trademark VELCRO®.

As particularly shown in FIG. 2, the cover 16 is folded over the interior side 13 of the top portion 11, the periphery of the top portion stiffening means 32 and the outer periphery of the attachment means 28; and is held in place by a first row of stitching 35. Similarly, the outer layer 17 is folded over the upper side 22 of the bottom portion 21, the periphery of the bottom portion stiffening means 31 and the outer periphery of the attachment means 28; and is held in place by the first row of stitching 35. However it is to be understood that in another embodiment (not shown) in which the bottom portion stiffening means 31 is omitted, the outer layer 17 is folded over the upper side 22 of the bottom portion 21 and the outer periphery of the attachment means 28; and is held in place by the first row of stitching 35. The attachment means 28 is also held in place by a second row of stitching 36 along the inner periphery of the attachment means 28.

A gap 19 is provided between the bottom portion stiffening means 31 and the top portion stiffening means 32. The gap 19 facilitates the ease of folding the top portion 11 over the bottom portion 21 because the gap reduces the bulk of the stiffening means at the fold.

Figure 4:
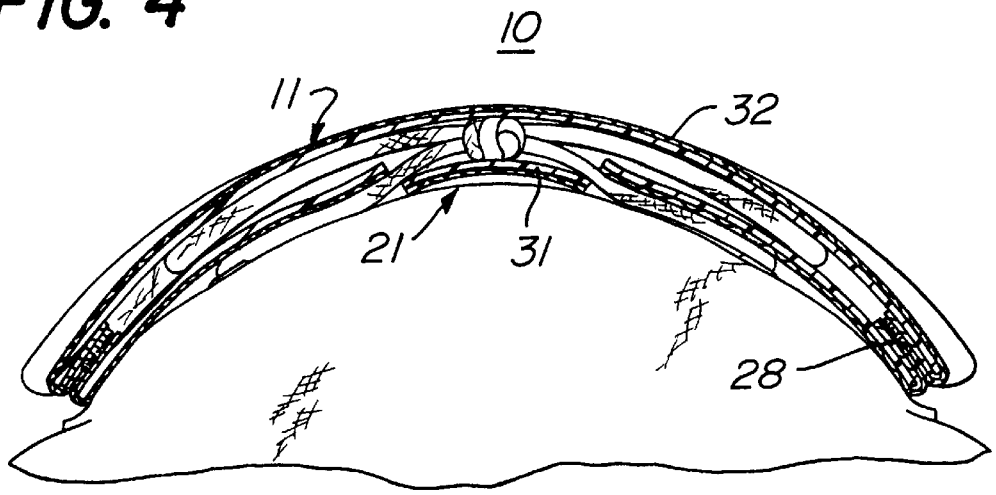
FIG. 4 is a cross-sectional view taken along section 4—4 of FIG. 1.

Attention is now turned to FIG. 4, which is a cross-sectional view taken along section 4—4 of FIG. 1. The extent to which the stiffening means 31, 32 creates a concave curvature in the device 10 is shown in this embodiment. The concave curvature enhances the ability of the device 10 to adhere to the curve of the footwear and the wearer's foot; thereby preventing ripping or snagging of the device 10 on foreign objects while in use.

FIG. 4 also shows the interaction of the attachment means 28, whereby when the device 10 is in the closed mode, the attachment means 28 of the top portion 11 engages with the attachment means 28 of the bottom portion 21.

Figure 5:
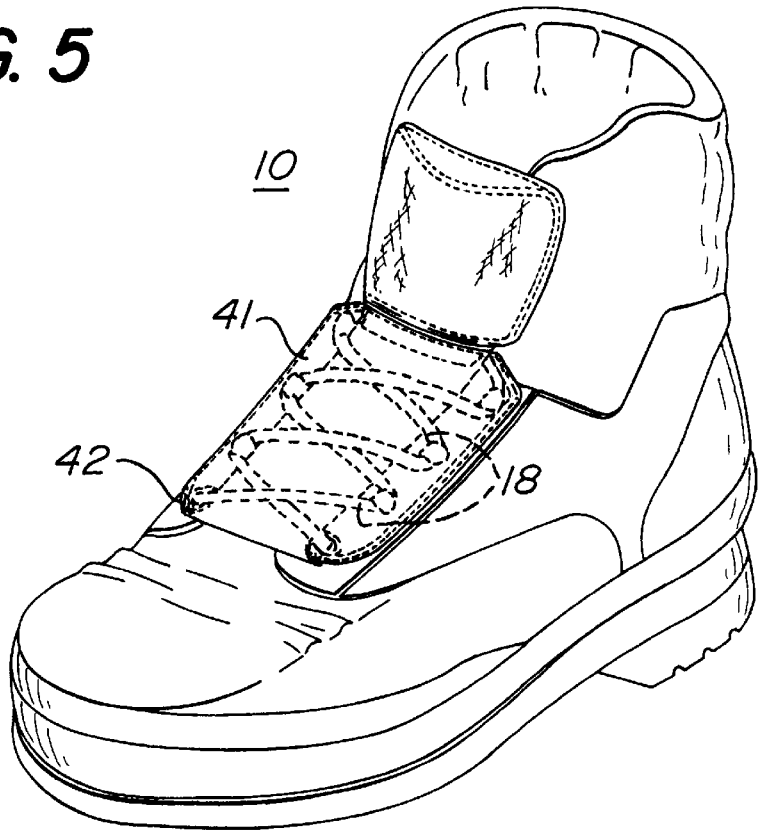
FIG. 5 is perspective view of a second embodiment of a fastener cover of this invention in a use condition.
Figure 6:
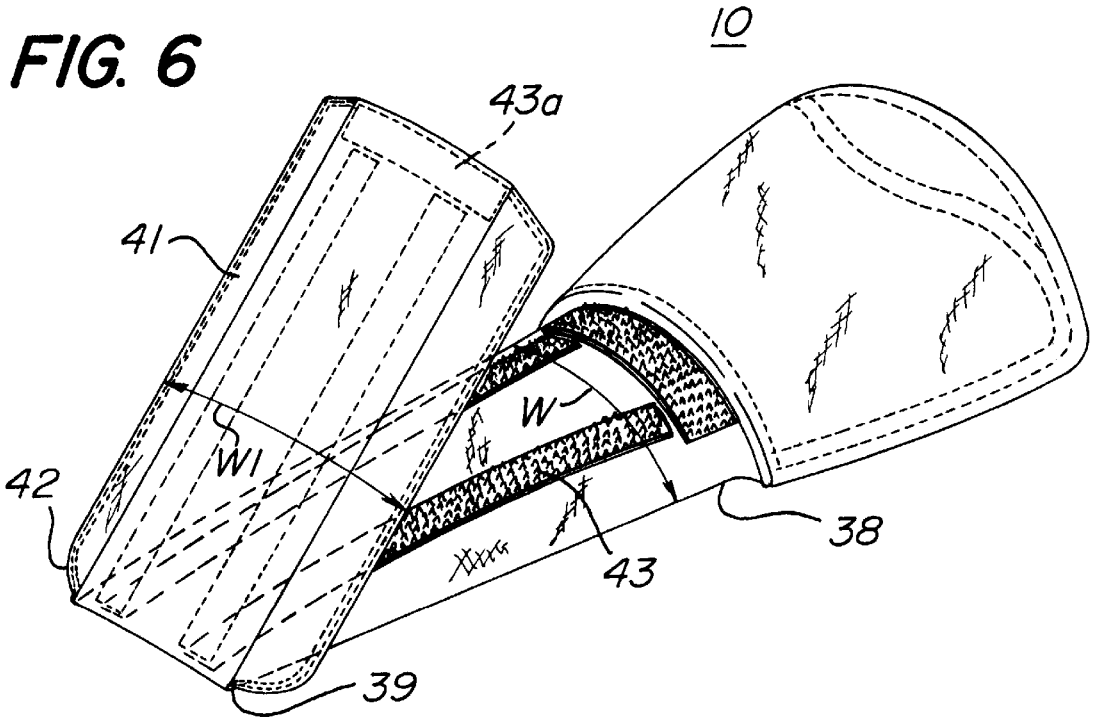
FIG. 6 is perspective view of the fastener cover shown in FIG. 5.

Reference is now made to FIG. 5, which is a perspective view of a main embodiment of this invention in a use mode, and FIG. 6, which is a perspective view of the invention shown in FIG. 5. As shown in FIG. 5 and FIG. 6, a base member 38 is attached to the bottom portion 21 (see FIG. 7) at the bottom portion toe end 25. The base part toe end 39 is foldably attached to a concealing top member 41 at the concealing part toe end 42.

FIG. 5 shows the base member 38 extending under the entire length of the fasteners which, in this embodiment, are laces. However, it is to be understood that the base member 38 extends under the laces only to the extent of the length of the base member 38. The base member 38 also may extend under footwear that has speed lacing. In the closed mode, as depicted in FIG. 5, the top member 41 is folded over the base member 38 so that the laces are contained, concealed, and protected thereby.

The width w1 of the top member 41 is wider than the width w of the base member 38. This embodiment enables the top member 41 to extend laterally so as to fully cover the laces.

Referring to FIG. 6, a connecting means 43 is provided along the periphery of the base member 38, excluding the base part toe end 39, and along the periphery of the top member 41, excluding the concealing part toe end 42. Although any connecting means may be used, a preferred means is the loop and hook material sold under the trademark VELCRO®.

Figure 7:
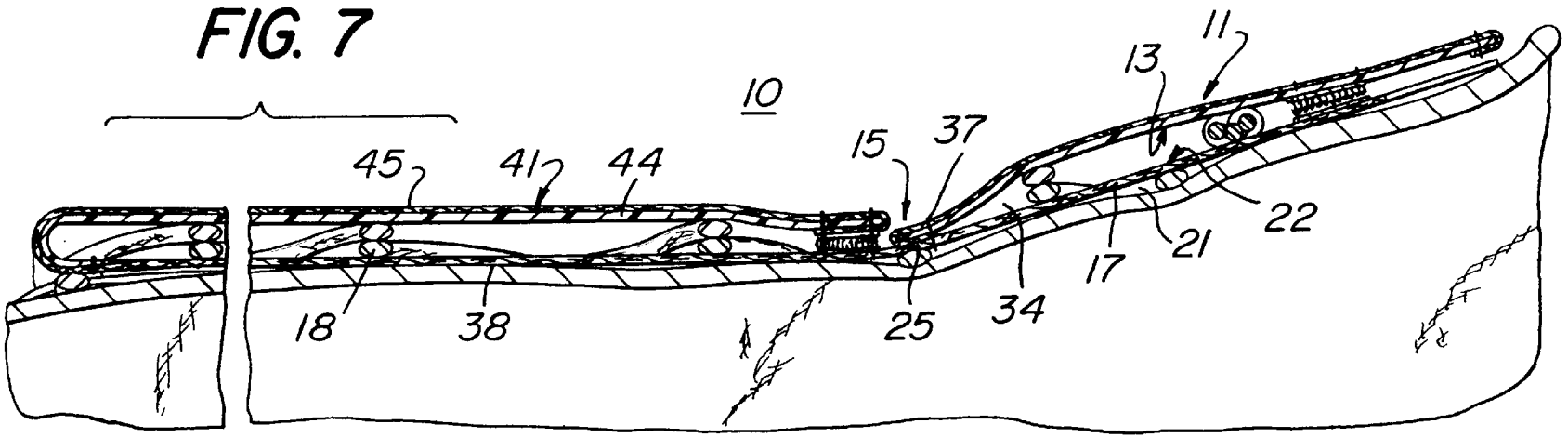
FIG. 7 is a sectional side view of the fastener cover shown in FIG. 5.

Attention is now turned to FIG. 7, which is a sectional view of the invention shown in FIG. 5. In this view, the outer layer 17 is integrally attached to the base member 38 and the top portion toe end 15 is attached to the bottom portion toe end 25 by stitches 37. When the device 10 is in the closed mode, a pocketed space 34 is defined between the interior side 13 of the top portion 11 and the upper side 22 of the bottom portion 21.

The concealing top member 41 contains a covering 45 that overlays a concealing part stiffening means 44. This stiffening means 44 may be fabricated from any suitable material, but a plastic sheet of any desired thickness is preferred.

Figure 8:
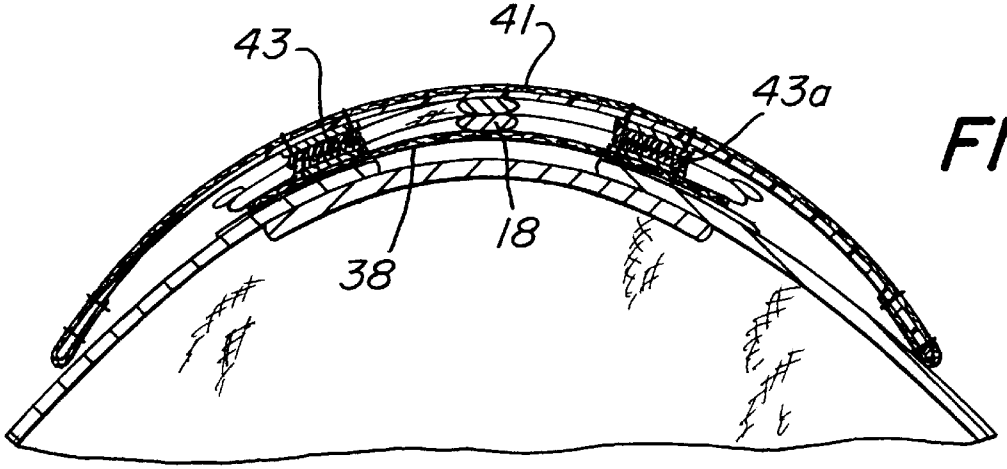
FIG. 8 is a cross-sectional view of the fastener cover shown in FIG. 5.

In FIG. 8, there is shown a cross-sectional view of a fastener cover (see FIGS. 5 and 6) in which the connecting means 43*a* on top member 41 and the connecting means 43 on base member 38 are disposed in such manner that when member 41 is folded down onto member 38, their respective connecting means 43 and 43*a* come into registry and the two members become intimately joined to one another.

In another embodiment of this invention, the cover 16 and covering 45 may contain a reflective material which can be made visible when the device 10 is worn in the dark.

According to still another embodiment, the cover 16 and the covering 45 may contain designs, emblems, logos, drawings or color combinations, for fashion purposes, or as advertising or to promote a favorite sports team or the like.

In yet another embodiment of the invention, the device 10 is made an integral part of the footwear during manufacture as, for example, by being made a part of the tongue of the footwear.

In still another embodiment of the invention, the device 10 is made of the same material as the footwear with which it is used.

While the preferred embodiments have been fully described and depicted for the purposes of explaining the principles of the present invention, it will be appreciated by those skilled in the art that modifications and changes may be made thereto without departing from the spirit and scope of the invention set forth in the appended claims.

What is claimed is:

1. A device for containing, concealing and protecting fasteners of footwear comprising:

a bottom portion having an under side and an upper side, said bottom portion including a means for insertion of said fasteners from said under side to said upper side for fastening said fasteners on said upper side;

a top portion;

an attachment means, said attachment means attaching said top portion on top of said upper side of said bottom portion and said fasteners, said attachment means being peripherally attached along the entire portions of said top portion and said upper side of said bottom portion;

a base member, said base member being integrally attached to said bottom portion and inserted under said fasteners;

a concealing top member; and a connecting means, said connecting means connecting said concealing part on top of said base part and said fasteners.

2. The device of claim 1 wherein said means for insertion of said fasteners is a first pair of openings.

3. The device of claim 1 wherein said attachment means is a hook and loop material sold under the trademark VELCRO®.

4. The device of claim 1 wherein said connecting means is a hook and loop material sold under the trademark VELCRO®.

5. The device of claim 1 made of a material selected from a group consisting essentially of cloth, leather, plastic and vinyl.

6. The device of claim 1 wherein said concealing part is wider than said base part.

7. The device of claim 1 wherein said device is made an integral part of said footwear during manufacture.

8. The device of claim 1 wherein said concealing top member is foldably attached to said base part.

9. The device of claim 1 further comprising a top portion stiffening means and a concealing top member stiffening means.

10. The device of claim 9 wherein said top portion stiffening means and said concealing top member stiffening means are made of plastic.

11. The device of claim 9 further comprising a concave curvature.

12. The device of claim 9 further comprising a bottom portion ankle end, and a top portion ankle end, said bottom portion ankle end including a curved indentation and said top portion stiffening means containing a curved indentation at said top portion ankle end.

13. The device of claim 12 wherein said top portion includes a cover.

14. The device of claim 13 wherein said cover includes a grip.

15. The device of claim 13 wherein said concealing top member includes a covering.

16. The device of claim 15 wherein said cover and said covering are made of a reflective material.

17. The device of claim 15 wherein said cover and said covering include designs consisting essentially of emblems, logos, color combinations and drawings.

18. The device of claim 1 wherein said fasteners are selected from a group consisting essentially of laces and a hook and loop material sold under the trademark VELCRO®.

19. The device of claim 18 wherein said bottom portion further comprises a second pair of openings wherein said laces are inserted from said under side to said upper side, crossed over each other, and inserted through said second pair of openings from said upper side to said under side.

20. The device of claim 18 wherein said base part is inserted under all of the said laces of the footwear.

21. The device of claim 1 further comprising a top portion toe end and a bottom portion toe end, wherein said top portion toe end is connected to said bottom portion toe end by stitches.

22. The device of claim 21 further comprising a pocketed space in between said top portion and said upper side of said bottom portion when said top portion is attached on top of said bottom portion.

* * * * *